United States Patent [19]

van Keulen

[11] 4,054,016

[45] Oct. 18, 1977

[54] DEVICE FOR FILLING BAGS

[75] Inventor: Frans van Keulen, Emmeloord, Netherlands

[73] Assignee: Francisco N.V., Willemstad, Netherlands Antilles

[21] Appl. No.: 725,107

[22] Filed: Sept. 20, 1976

[30] Foreign Application Priority Data

Sept. 19, 1975 Netherlands ..... 7511133

[51] Int. Cl.² ..... B65B 57/02; B65B 43/26

[52] U.S. Cl. ..... 53/64; 53/183; 53/187

[58] Field of Search ..... 53/64, 74, 183, 187

[56] References Cited

U.S. PATENT DOCUMENTS

| | | | |
|---|---|---|---|
| 3,359,703 | 12/1967 | Quaadgras | 53/187 X |
| 3,746,057 | 7/1973 | Titchenal | 53/187 X |

*Primary Examiner*—Travis S. McGehee

*Attorney, Agent, or Firm*—Miller & Prestia

[57] ABSTRACT

In a machine for filling bags, which bags are positioned one next to the other in a double web in which the bottom and sides are defined by joints between the two layers of the web, a diverging guiding means for guiding only one upper web edge and a means for pulling the other upper web edge away from the first edge are provided.

9 Claims, 4 Drawing Figures

DEVICE FOR FILLING BAGS

The invention relates to a device for filling bags, which are formed by webs of material, which, with their edges extending horizontally and their planes oriented vertically are provided with vertical joints connecting the webs to each other. The vertical joints extend upwardly from the lower edge of the webs and the lower edges of the webs are connected to each other. The device is provided with horizontally extending guide surfaces having a portion wherein the guide surfaces are bent away from each other in a horizontal plane and then bent back again. The device also includes two endless concurrently drivable transport belts that are mounted such that the one is moving along one of said guide surfaces and the other along the other of said guide surfaces.

A known device of this type is provided with guide surfaces, that diverge at a certain portion; bath surfaces engage an upper edge of the web over the entire extend of said portion. Consequently it is only possible to have the edges spread a small distance from each other or to have the joints connecting the webs to each other terminate at a large distance from the upper edges of said webs, because otherwise it would be impossible to let a joint pass the point where the edges are mostly spaced from each other. This feature is a dominating drawback of this known device, very definitely limiting its practical use.

To overcome this drawback it has already been proposed to have the guide surfaces and the belts cooperating therewith move away from each other. This is an expensive and complicated construction, because the path of the endless belts is lengthened locally by this, so that another location it has to be shortened.

This latter being obtained by displacing guide rolls for the belts. Further this complication slows down the machine speed, because it is not or only partly possible to concurrently move the webs forward and the guide surfaces away from each other.

Accordingly it is a first object of the invention to overcome the above described disadvantages.

A further aim of the invention is to provide a device of the type described of simple, cheap construction, having a high reliability and high performance.

The above objects are realized according to the invention in that one surface in the spout portion is a surface of a guide member totally disposed within said portion, so that at both ends of said portion a passage is left free for the upper edge portion of one of the material webs. Moreover, a moving pulling member is disposed in the spout portion and is movable from a first position near to the guide surface that is not totally disposed within said portion towards a second position further away from the last mentioned guide surface and closer to the guide member surface totally disposed within said spout portion.

It is noted, that the invention is equally useful in cases in which the webs are before hand provided with the joints and in cases in which the joints are made by the device itself. Further the device may be provided with means for sewing or sealing the upper edges and for forming the upper part of the vertical joints and for cutting off filled and closed bags. All these features are known per se and do not form part of the invention.

The invention is further explained in the following description of a preferred embodiment, illustrated in the accompanying drawing in which:

FIG. 1 schematically shows a plan view of an embodiment of the invention;

FIG. 2 schematically shows an elevation of the embodiment of FIG. 1;

Figure 1:
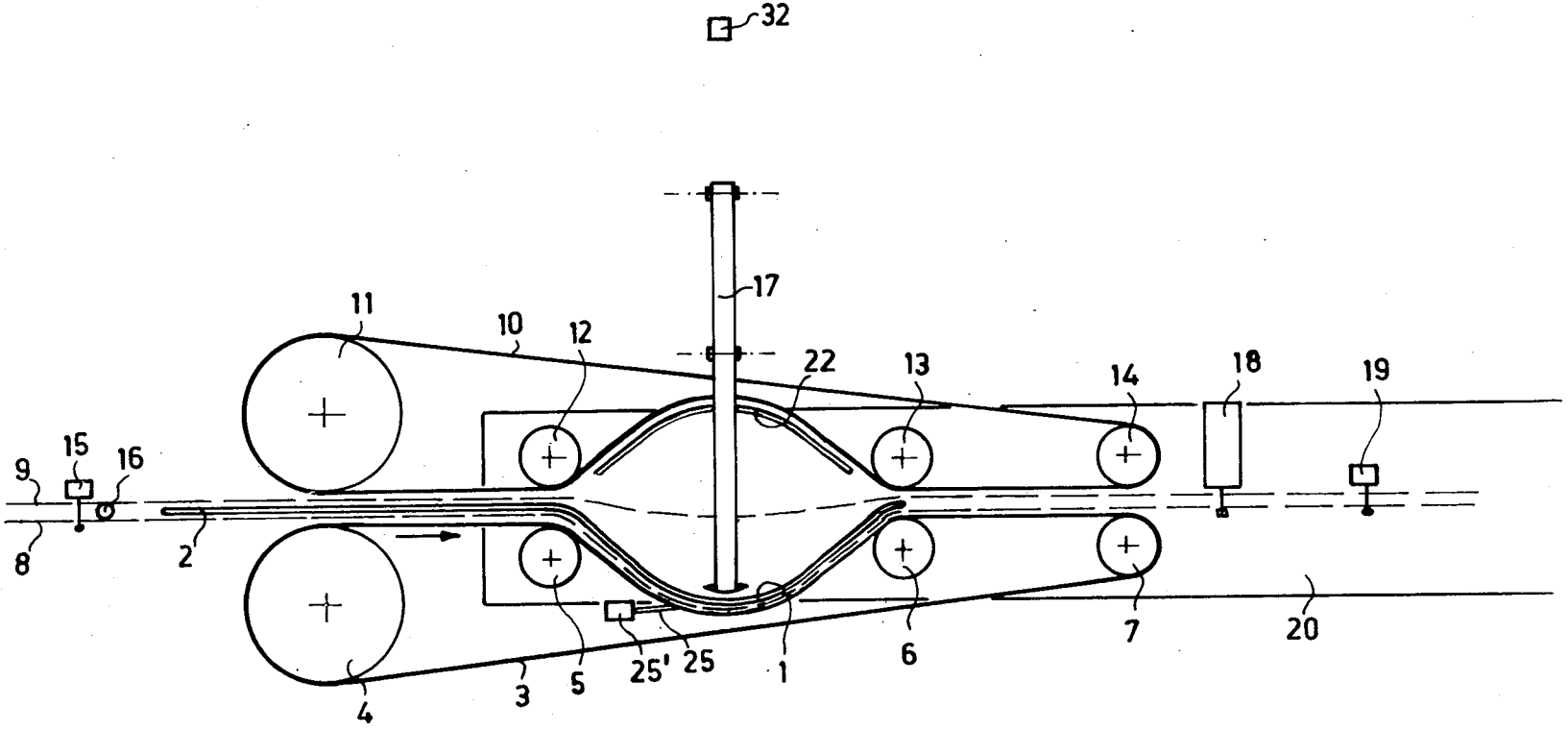

In FIG. 1 a bent guide 1 is shown having at its left hand side a precursor 2. An endless belt is carried over a number of rolls 4, 5, 6 and 7, such that the belt between the rolls 5 and 6 is pressed against the guide 1. Between the guide 1 and the precursor 2 on the one hand and the belt 3 on the other hand an upper edge 8 of a textile web that at its lower side is folded back, is located. The other upper edge of the double web is indicated by 9. The edge 8 is pressed between the precursor 2 and the guide 1 on the one side and the belt 3 on the other side. This belt is provided with ribs (not shown) at its surface engaging the edge 8, so that it can retain and when it moves can take along the edge 8.

Against the opposing side of the precursor 2 lies the other upper edge 9 that is pressed between a belt 10 running over rolls 11, 12, 13 and 14 and said precursor. Belt 10 is identical to belt 3.

In the portions between the rollers 5 and 6 the edge 8 is retained between a surface or the members 2 and 1 that in FIG. 1 is at the lower side and is the first guide surface. In the portion between the rollers 12 and 13 the edge 9, however, is free.

The surface of a guide member 22, which in FIG. 1 is the upper surface, immediately engages belt 10 without a web edge therebetween.

Figure 2:
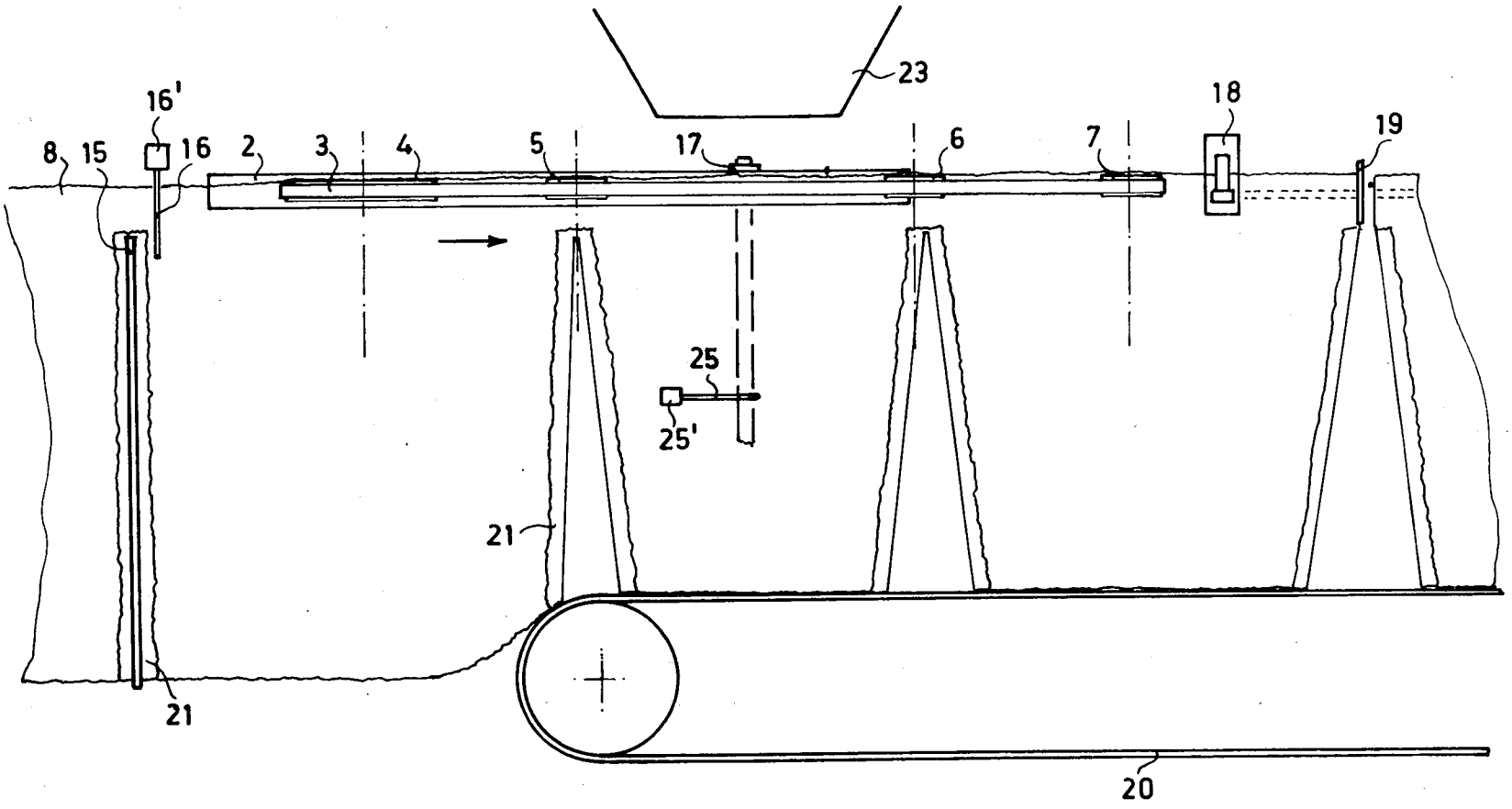
Figure 3:
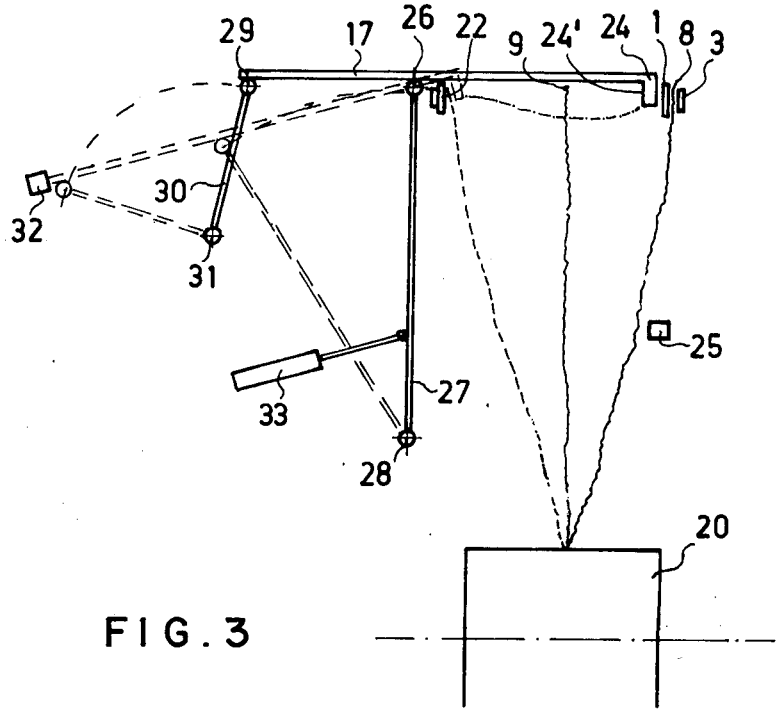
FIG. 3 shows schematically a detail.

Further the device is provided with a cutting-in device 15, having for instance an electrically heated wire, a sensor 16 connected to a switch 16′ (FIG. 2), a pulling member 17, further illustrated in FIG. 3, a bag closing device 18, for instance a stitching machine 18 and a cutting-through device 19, which may contain an electrically heated wire. Further a bag supporting transport belt is indicated at 20.

As specifically indicated in FIG. 2 the double web having upper edges 8 and 9 is provided with joining zones in which the material is joined together. If for instance the material is meltable, it may be sealed or melted together. These zones are indicated at 21. The cutting device 15 cuts these zones from the lower side. The loose upper edges above the zones 15 are rather small, i.e. 5 cm, and form the connection between adjacent bag parts of the double web.

The supporting transport belt 20 has its upper belt portion located above the level of the free depending double web in order to support the bags when they are filled preventing the weight of the contents of the bags from pulling the edges 8 and 9 downward.

The device described works in the following way: When the belts 3 and 10, which have a combined driving means, move in the direction of the arrow a zone 21 will actuate the sensor 16, which activates the switch 16′ to interrupt the driving of belts 3, 10 and 20. Then the cutting devices 15 and 19 are activated as well as a driving means for the pulling member 17, which moves the upper edge 9 away from the guide 1 towards the guide member 22. After this a conventional filling apparatus (not shown) is activated to fill by means of the hopper 23 the bag between the two joint zones.

Filling the bag activates a further sensor 25, controlling a switch 25′.

Activation of switch 25' causes the belts 3 and 10 to move as well as the belt 20, that is coupled to the belts 3 and 10, so that a filled bag is supported by belt 20 and moves towards the right side in FIG. 1 and 2. When the sensor 25 is not further activated by the filled bag the sensor 16 is already passed by the upper side of the joint zone 21, so that switch 16' provides the further energizing of the driving means for belts 3, 10 and 20.

In FIG. 3 an embodiment of the pulling member 17 and its driving means has been shown. The member 17 at one end is provided with a hook portion 24 having a roughened surface 24'. Member 17 is at 26 pivotably connected to a support arm 27, pivotably mounted to a fixed pivot 28. The left end of member 17 is at 29 pivotably connected to a link 30, pivotably mounted to a fixed pivot 31. This end of member 17 cooperates with a switch 32 in the end position of its counterclockwise movement indicated with an interrupted line.

Because the link 30 is shorter than the arm 27 and tilts somewhat in its first position, indicated with uninterrupted lines, the hook portion 24 will describe a path indicated with a dot dash line in FIG. 3, that is to say first somewhat descending and afterwards ascending.

The roughened surface 24' of hook portion 24 will engage the free edge 9 of the web when the hook portion is in about its lowest position. Then it moves somewhat upwardly taking the web along in a very reliable way.

The arm 17 is swung to and fro by a penumatic cylinder 33 controlled by an electromagnetic valve 34.

Figure 4:
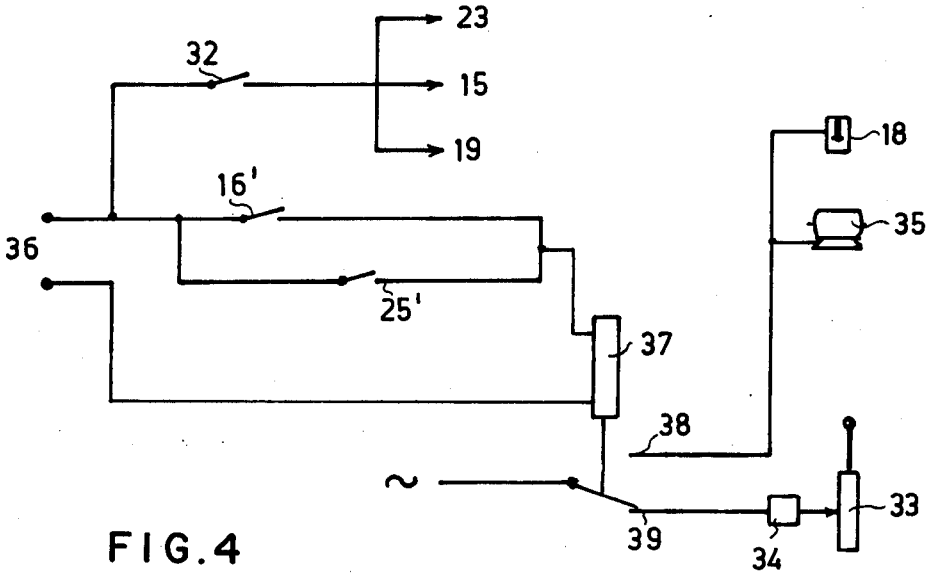
FIG. 4 shows the electric and pneumatic control scheme of the embodiment of FIGS. 1, 2 and 3.

In the scheme of FIG. 4 control voltage is received at terminals 36. One terminal 36 can be connected via the switch 16' or the switch 25' to one side of the energizing coil of a relay 37, the other side of the coil being immediately connected to the other terminal 36.

When relay 37 is energized it energizes via 38 the motor 35 for the three belts 3, 10 and 20 and the stitching machine 18.

When it is not energized it controls via 39 the electro magnetic valve 34. Valve 34, when energized, moves member 17 to the left, so that switch 32 will be closed. Closing of switch 32 activates a (non shown) device at the hopper 23 for filling a bag, the cutting-in device 15 and the cutting-through device 19.

When the bag is filled switch 25' will be closed and relay 37 energized, so that motor 35 and stitching machine 18 are running. In the means time sensor 16 will not be further engaged by a joint 21 and will fall back again closing switch 16'. Switch 25' opens when the filled bag is moved away, but this has no influence until the next joint 21 arrives near the sensor 16 and opens switch 16' again. Then relay 37 energizes again via 39 the valve 34 and by this cylinder 33. This cylinder is of a well-known type that when the electro magnetic valve is not energized, returns to one position, in this case that shown in FIG. 3.

What is claimed is:

1. In a device for filling bags formed from webs of material, wherein the webs are positioned with a pair of horizontally extending top and bottom edge portions and generally vertically oriented planar portions and wherein the webs are connected along their bottom edges and joints extend vertically upwardly from the bottom edges of the webs, the improvement comprising:

a. a pair of endless transport belts;

b. a first driving means for concurrently driving said belts;

c. a pair of stationary guide members, each having a concave horizontal portion adjacent one of said transport belts, each of said horizontal portions opposed to each other to define a spout portion, the top edge of one web interposed between one of said guide members and one of said transport belts, the other web top edge remaining freely disposed within said spout portion;

d. a pair of guide roller means, each said guide roller means to guide a transport belt along one of said guide members; and e. pulling means movably mounted in said spout portion for grasping said freely disposed web edge and pulling it in a direction traverse to said guide members to place the bag in a position ready for filling.

2. A device according to claim 1, in which the pulling means further includes second drive means to lower its level in a first portion of its path of movement from a second position and to heighten its level in a second portion of its path of movement when attaining said second position.

3. Device according to claim 1, wherein one of said guide surfaces is formed with a precursor member.

4. A device according to claim 1, further including, first sensor means to sense the arrival of a bag in a position wherein a joint is at the beginning and the next joint is at the end of said spout portion, and second sensor means to sense whether a bag has been filled, said first sensor means being connected to a driving means of the endless transport belts for stopping it and the second sensor means connected to said driving means for starting it.

5. A device according to claim 2, further including control means connecting said first drive means and said second drive means for alternately actuating said first and second drive means.

6. A device according to claim 5 wherein said control means further includes bag sensing means for sensing the full condition of a bag.

7. A device according to claim 6 wherein said first drive means is actuated in response to said bag sensing means.

8. A device as recited in claim 5 further including a control relay connected between two terminals of an electrical network, one of said terminals including two parallel branches, each branch including a switching means, one switching means including a sensor responsive to the empty or filled condition of a bag so that the switching means is closed when the bag is full, the other switching means including a sensor responsive to the passage of an upwardly extending bag joint to open the switch.

9. A device as recited in claim 7 wherein said control relay includes a contact arm movable between two conductors, one conductor connected to said first drive means, the other conductor connected to said second drive means.

* * * * *